United States Patent [19]

Shindo et al.

[11] 4,048,470

[45] Sept. 13, 1977

[54] EXOTHERMIC PRINTING HEAD

[75] Inventors: Takemasa Shindo; Kenichiro Arai, both of Shiojiri, Japan

[73] Assignees: Shinshu Seiki Kabushiki Kaisha; Kabushiki Kaisha Suwa Seikosha, both of Tokyo, Japan

[21] Appl. No.: 615,864

[22] Filed: Sept. 23, 1975

[30] Foreign Application Priority Data

Sept. 30, 1974 Japan ..... 49-112484

[51] Int. Cl.[2] ..... H05B 1/00

[52] U.S. Cl. ..... 219/216; 219/543; 219/553

[58] Field of Search ..... 219/216, 543, 553; 346/76 R

[56] References Cited

U.S. PATENT DOCUMENTS 3,903,393 9/1975 Stapleton ..... 219/216

*Primary Examiner*—C. L. Albritton

*Attorney, Agent, or Firm*—Blum, Moscovitz, Friedman & Kaplan

[57] ABSTRACT

An exothermic type printing head is provided including a substrate, and electric conductors and exothermic elements mounted on the substrate. At least one common electric conductor is mounted on the substrate. Each common conductor has a plurality of branches extending therefrom. A corresponding plurality of discrete electrically conductive elements are also mounted on the substrate. Each of the electrically conductive elements is longitudinally arranged between a pair of branches extending from the common conductor. At least one integral exothermic element of predetermined width is mounted on the substrate overlying the discrete electrically conductive elements and branches of each common conductor. Signals are supplied to the common conductors from a common source.

9 Claims, 16 Drawing Figures

EXOTHERMIC PRINTING HEAD

BACKGROUND OF THE INVENTION

This invention relates to an exothermic type printing head for forming a print pattern on thermally sensitive paper.

Conventional exothermic type printing heads include several disadvantages. The principal disadvantages are their generally high cost and unstable printing quality. The printing quality of these conventional exothermic printing heads is related to the distance between the dots or segments provided by the exothermic elements in the device.

Accordingly, the instant invention provides an exothermic type printing head having improved printing quality. This improved exothermic type printing head also provides generally stable performance. In this improved device, the distance between neighboring exothermic elements is reduced.

SUMMARY OF THE INVENTION

Generally speaking, in accordance with the invention, an improved exothermic type printing head is provided. The improved printing head generally includes a substrate and electric conductors and exothermic elements mounted on the substrate.

In this improved device, at least one common electric conductor is mounted on a suitable substrate. Each common conductor has a plurality of branches extending therefrom which extend unidirectionally in parallel. A corresponding plurality of discrete electrically conductive elements are also mounted on the substrate. Each of the electrically conductive elements is longitudinally arranged between a pair of branches extending from the common conductor.

At least one integral exothermic element of predetermined width is mounted on the substrate overlying the arranged electrically conductive elements and branches of the common conductors. Signals are supplied to the common conductors from a common source.

Accordingly, it is an object of the invention to provide an exothermic type printing head having an improved construction.

It is another object of the invention to provide an exothermic type printing head with improved printing qualities.

Another object of the invention is to provide a mass producible exothermic type printing head at lower unit cost.

Still another object of the invention is to provide an exothermic type printing head having improved endurance.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1A:
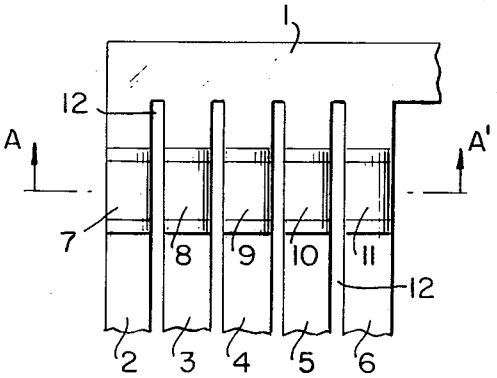
FIG. 1 is a fragmentary detail view of the conventional arrangement of elements in the known exothermic type printing head.
FIG. 1*b* is a sectional view of the embodiment seen in FIG. 1*a*, taken along line A—A'.
FIG 1*c* is representative of the type of character provided by the known exothermic type printing head.
Figure 1B:
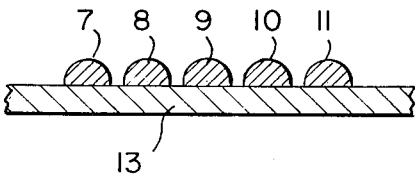
Figure 1C:
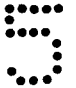

Referring now to FIGS. 1*a*–*c*, the conventional arrangement of electric conductors and exothermic elements of providing a character having $5 \times n$ dots may be seen. Mutually connected to a common electrode conductor 1 are a plurality of electric conductors 2, 3, 4, 5 and 6 which respectively actuate a corresponding plurality of exothermic elements 7, 8, 9, 10 and 11 mounted thereon. Exothermic elements 7–11 are selectively heated by their corresponding electric conductor 2–6 for thereby providing a signal. When a thermally sensitive paper or other medium is applied to the head, the signal is recorded on that paper or medium as a dot. By selectively signaling specific exothermic elements on specific conductors, a particular arrangement of dots may be formed into a character, for instance as seen in FIG. 1*c*.

So that the arrangement of dots has a recognizable appearance, efforts have been made to reduce the series of gaps 12 between respective exothermic elements, for instance, elements 7–11. Such efforts require precision engineering to preserve the regularity of the appearance of dots in the formed character.

Accordingly to one method for sizing the gaps between exothermic elements, a mesh screen is employed. However, the resolution limit of the sizing of gaps 12 is found to be about 150 microns. Exothermic type printing heads fabricated in this manner generally exhibit varied resistance values across their respective exothermic elements and standardization for mass production of printing heads having this type of construction is not generally obtainable.

Respective cross-sections of exothermic elements 7–11 may be seen in FIG 1*b*. The embodiment seen in FIG. 1*b* is exemplary of a typical "thick film" printing system and in such a system the respective surfaces of exothermic elements 7–11 are rounded by the viscosity and the action of surface tension of the resistance paste, even if the effort to reduce gaps 12 is made. Therefore, at the time of printing a character on thermally sensitive paper or a like medium, the thermally sensitive recording medium and exothermic elements are arranged such that the area of contact therebetween is substantially limited to a plurality of points. The character seen in FIG. 1*c* is representative of the type of print character provided by this type of system. The small area of contact between the printing head and medium emphasizes the gaps between respective exothermic elements of the printing head. In other words, while it may be possible to narrow the gaps between each exothermic element, the fact that the area of contact between each exothermic element and the printing medium is so small results in a character having substantial spacing between the imprints made by the respective exothermic elements on the medium. Therefore, providing the printing head with narrowed gaps between exothermic elements does not result in a thermally printed character with suitable spacing between the thermal indications forming the print character.

Figure 2A:
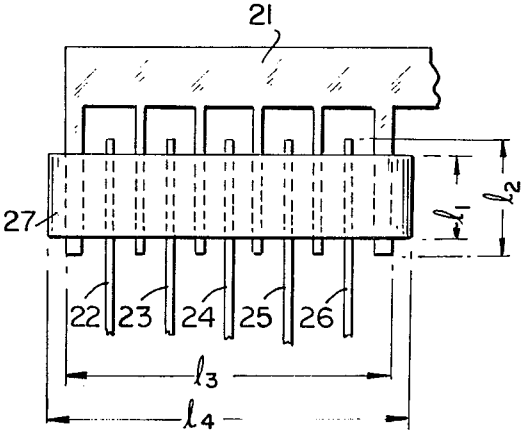
FIG. 2*a* is a fragmentary detail view of the arrangement of elements in an exothermic type printing head constructed in accordance with the instant invention.
Figure 2B:
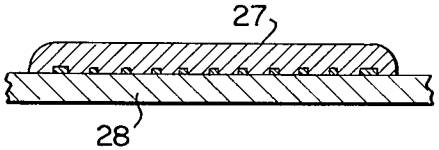
FIG. 2*b* is a sectional view of the embodiment seen in FIG. 2*a;*
Figure 2C:
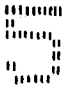
FIG. 2*c* is representative of the type of print character provided by the embodiment seen in FIG. 2*a;*

Accordingly, the instant invention provides a printing head construction having an arrangement of elements resulting in a print character with suitably spaced thermal indications on the thermally sensitive medium. Referring now to FIGS. 2*a–c*, a common electric conductor 21 is provided with a plurality of longitudinally arranged lateral extensions mounted on a substrate 28. A plurality of electric conductors 22–26 corresponding to the number of lateral extensions provided in common conductor 21 is mounted on substrate 28 in the manner seen in FIGS. 2*a* and 2*b*. Each of electrical conductors 22–26 is longitudinally arranged on substrate 28 and extends longitudinally between a respective pair of longitudinally arranged lateral extensions of common conductor 21. Dot signals are supplied to conductors 22–26 for providing a thermal imprint of a thermally sensitive medium.

An exothermic element 27 overlies the longitudinal arrangement of electric conductors on substrate 28. As seen in FIG. 2*a*, the distance $l_2$ between the top edge of each of electric conductors 22–26 and the lower edge of each extension of common conductor 21 is greater than the length $l_1$ of exothermic element 27. Additionally, the distance $l_3$ between the first and last extension of common conductor 21 is shorter than the length of exothermic element 27.

With this type of arrangement of elements, printing may be performed more easily than with a printing head having the conventional construction seen in FIGS. 1*a–c*. Additionally, a printing head having this type of arrangement of elements may be fabricated without the precision tooling required for devices having the conventional construction. When an exothermic element of the type having the construction of exothermic element 27 is employed, variations of the resistance value between each of electric conductors 22–26 and common conductor 21 can be substantially disregarded.

As best seen from FIG. 2*b*, only the residue of the resistance paste remains along the sides of exothermic element 27 and the surface of exothermic element 27 is substantially planar within the area defined between $l_3$. Therefore, the surface area of the printing head which may contact the thermally sensitive medium during printing has substantial surface area and has a surface area which is substantially larger than the corresponding surface area of the conventional type head, as seen be comparing FIGS. 1*b* and 2*b*. A character of the type seen in FIG. 2*c* is obtained within a printing head having the construction disclosed in FIGS. 2*a* and 2*b*.

As may be seen from FIG. 2*a*, electric conductors 22–26 provide the means for thermally imprinting the selected array of dots on a media. The current for providing electric conductors 22–26 with the dot signal flows currently from the adjacent pair of lateral extensions provided in common electric conductor 21. Therefore, current to each of electric conductors 22–26 flows from the right and left thereof whereby each electric conductor 22–26 provides a pair of aligned signal dots, one on the right hand side of the conductor and one on the left hand side of the conductor. Therefore, although five electric conductors are arranged in the embodiment seen in FIGS. 2*a* and *b* for providing dot signals, a character is formed having double the number of dots, as seen in FIG. 2*c*, whereas in the conventional type device, as seen in FIG. 1*a*, an arrangement having five electric conductors 2–6 provides half the number of indicia as the new arrangement. Additionally, the indicia provided according to the embodiment seen in FIGS. 2*a* and *b* substantially have a continuous character line as compared with the spaced dots of the conventional device. In this arrangement, the gapping problem characteristic of the conventional devices may be overcome by employing relatively thin electric conductors 22–26. The gapping problem is further overcome according to this embodiment since one exothermic element 27 is employed, as compared with the plurality of exothermic elements 7–11 of the prior art device.

Figure 3A:
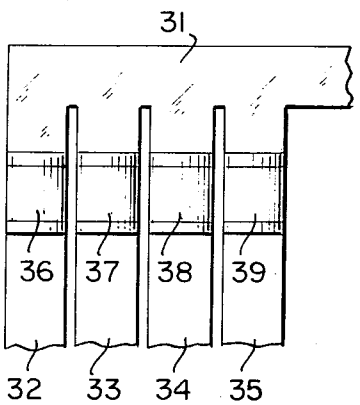
FIGS. 3*a*–3*c* are representatively, views of the arrangement of elements and the character provided thereby in a known exothermic type printing head, wherein the character is provided by 4×n dots.
Figure 3B:
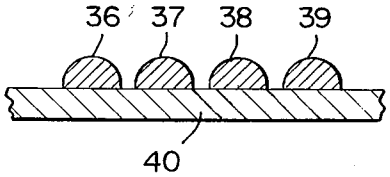
Figure 3C:
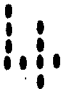

While FIGS. 1*a* and 1*b* show a conventional arrangement for providing a character with $5 \times n$ dots, FIGS. 3*a* and 3*b* show the same arrangement as modified for providing a character having $4 \times n$ dots. Therefore, the arrangement of common electric conductor 31 and conductors 32–35 issuing therefrom, each having a respective thermal element 36–39 mounted thereon, is identical to the arrangment seen in FIGS. 1*a* and 1*b*, except that the embodiment of FIGS. 3*a* and 3*b* has one less electric conductor and thermal element than the embodiment seen in FIGS. 1*a* and 1*b*. Corresponding to the embodiment seen in FIGS. 1*a* and 1*b*, the embodiment seen in FIG. 3*a* is mounted on a substrate 40, as best seen in FIG. 3*b*. The type of character provided by the arrangement seen in FIGS. 3*a* and 3*b* is shown in FIG. 3*c*.

Figure 4A:
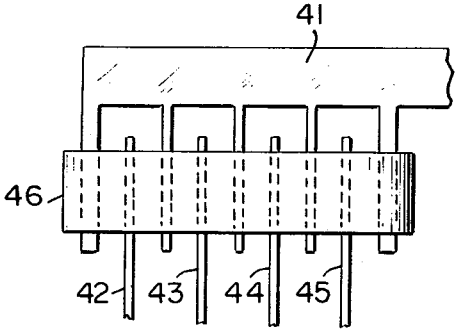
FIGS. 4*a* and 4*b*, respectively, are fragmentary detail views of the arrangement of elements in another exothermic type printing head constructed in accordance with the instant invention.
Figure 4B:
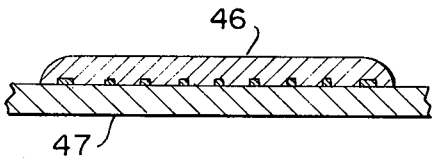
Figure 4C:
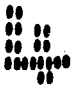
FIG. 4*c* is a representative print character of the type provided by the embodiment seen in FIGS. 4*a* and 4*b;*

Similarly, the embodiment seen in FIGS. 4*a* and 4*b* corresponds identically to the arrangement seen in FIGS. 2*a* and 2*b* except that this embodiment has one less electric conductor than the embodiment seen in FIGS. 2*a* and 2*b*. Therefore, in the embodiment seen in FIGS. 4*a* and 4*b* four electric conductors, 42–45, are interposed between respective pairs of extensions issuing from common conductor 41. Conductors 42–45 are mounted on a substrate 47 and exothermic element 46 overlies conductors 42–45 on substrate 47, corresponding to the embodiment seen in FIGS. 1*a* and 1*b*. The character seen in FIG. 4*c* is exemplary of the type of character printed within a printing head having this type of arrangement. The arrangement of elements in this embodiment is substantially identical to the arrangement discussed in detail in connection with the embodiment seen in FIGS. 2*a* and 2*b*.

Figure 5A:
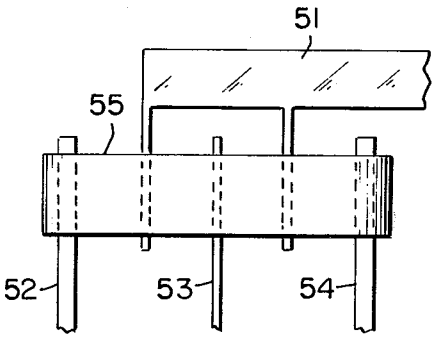
FIGS. 5*a* and 5*b*, respectively, are fragmentary detail views showing the arrangement of elements in still another exothermic type printing head embodiment constructed in accordance with this invention.
Figure 5B:
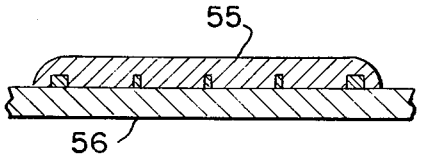
Figure 5C:
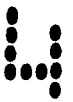
FIG. 5*c* is exemplary of the type of print character provided by the embodiment seen in FIGS. 5*a* and 5*b*.

Referring now to FIGS. 5*a* and *b* which illustrate another embodiment within the scope of the invention, three electric conductors 52–54, which supply dot signals, are mounted on a substrate 56 in particular relationship to common conductor 51. Issuing from common conductor 51 is one pair of longitudinally arranged lateral extensions, each extension of that pair being arranged adjacent to electric conductor 53. Therefore, as hereinbefore described in connection with the embodiment seen in FIG. 2*a*, electric conductor 53 provides a pair of dot signals to exothermic element 55 by the mechanism of right and left hand current flows thereto from common conductor 51. Current to electric conductors 52 and 54 flows in one direction from the respective lateral extensions in common conductor 51. Therefore, three electric conductors may be employed while providing four dot signals across, as best seen in FIG. 5*c*. As in the embodiments heretofore discussed in detail, an exothermic element 55 overlies conductors 52–54 and the same relationship of distances among elements is maintained. With this type of embodiment the cost of the peripheral circuitry in the printing head may be lowered since a diode may be employed.

Figure 6:
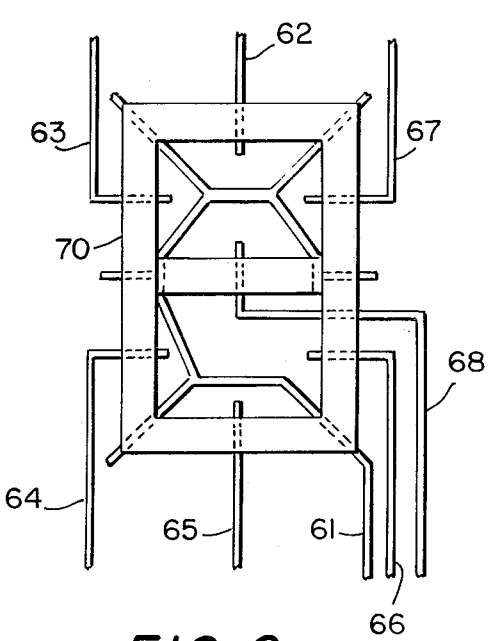
FIG. 6 is a plan view of an arrangement of elements of an exothermic type printing head constructed in accordance with this invention.

Referring now to FIG. 6, yet another embodiment showing an arrangement of elements within the scope of the invention may be seen. In this embodiment an exothermic element 70 is arranged between a common electric conductor 61 and electric conductors 62–68, which are arranged to provide segment signals to exothermic element 70. In this type of arrangement, the mechanism of providing a current flow to each side of each conductive element 62–68 is employed. The mechanism for producing this type of current flow is identical to the type of arrangement hereinbefore described in connection with the embodiment seen in FIG. 2*a*. In other words, each of the conductive elements 62–68 is arranged between a pair of extensions issuing from the common conductor and each conductive element provides an indicia having two segments.

Arrangements within the scope of this invention are easy to fabricate and inexpensive. Additionally, a variety of arrangements within the scope of the invention may be mass produced. Embodiments within the scope of the invention provide printed indicia with improved spacing between the dots or segments making up the indicia.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved exothermic printing head for thermally recording a printing character on a thermally sensitive medium comprising a substrate, a first conductor means mounted on said substrate, said first conductor means including at least one pair of commonly referenced conductors, second conductor means mounted on said substrate and including a second conductor disposed intermediate each pair of commonly referenced first conductors, and exothermic means overlying each said first pair of conductors and second conductor disposed intermediate said pair of first conductors, said exothermic means being adapted to be activated to produce a pair of dots on said thermal sensitive medium in response to said second conductor means being referenced to a potential different than the potential at which said first pairs of conductors are commonly referenced.

2. An improved exothermic type printing head for thermally recording a printing character on a thermally sensitive medium as claimed in claim 6, wherein said first conductor means includes at least two pairs of longitudinally arranged conductors.

3. An improved exothermic type printing head for thermally recording a printing character on a thermally sensitive medium as claimed in claim 2, wherein the ends of said commonly referenced pairs of first conductors extend to a point beyond that of the ends of said second conductors disposed intermediate each pair of first conductors.

4. An improved exothermic type printing head for thermally recording a printing character on a thermally sensitive medium as claimed in claim 3, wherein the width of said exothermic means is less than the distance between the ends of said pairs of first conductors and the ends of said second conductors.

5. An improved exothermic type printing head for thermally recording a printing character on a thermally sensitive medium as claimed in claim 2, wherein said longitudinally arranged first pairs of conductors extend in parallel with respect to each other, said first pairs of conductors and said second conductors disposed intermediate said first pairs of conductors being arranged on said substrate to extend oppositely toward each other.

6. An improved exothermic type printing head for thermally recording a printing character on a thermally sensitive medium as claimed in claim 2, wherein said second conductors are substantially equally spaced from each of said first conductors defining each of said first conductor pairs.

7. An improved exothermic type printing head for thermally recording a printing character on a thermally sensitive medium as claimed in claim 2, wherein said exothermic means has a length greater than the distance between the furthest most spaced apart conductors of said respective pairs of first commonly referenced conductor pairs.

8. An improved exothermic type printing head for thermally recording a printing character on a thermally sensitive medium as claimed in claim 1, wherein said exothermic means define bars of a seven bar display and wherein each of said pairs of said commonly referenced first conductors define end points of each said bar and wherein said second conductors are electrically coupled to said bars intermediate the end points thereof.

9. An improved exothermic type printing head for thermally recording a printing character on a thermally sensitive medium as claimed in claim 1, said second conductor means including at least one additional second conductor mounted externally of one of said pairs of said commonly referenced first conductor pairs.

* * * * *